US005329748A

United States Patent [19]

Belsito

[11] Patent Number: 5,329,748

[45] Date of Patent: Jul. 19, 1994

[54] NESTED PLASTIC TRAY SEPARATOR APPARATUS PACKAGING SYSTEM AND METHOD

[75] Inventor: Kenneth J. Belsito, Hyannis, Mass.

[73] Assignee: Sencorp Systems, Inc., Hyannis, Mass.

[21] Appl. No.: 6,249

[22] Filed: Jan. 19, 1993

[51] Int. Cl.[5] ..... B65B 5/06; B65B 35/50; B65B 57/20

[52] U.S. Cl. ..... 53/440; 53/127; 53/447; 53/540; 53/500

[58] Field of Search ..... 53/440, 447, 443, 500, 53/501, 540, 542, 559, 453, 127

[56] References Cited

U.S. PATENT DOCUMENTS

| | | | |
|---|---|---|---|
| 1,857,082 | 5/1932 | Hall | 53/500 |
| 2,765,602 | 10/1956 | Hibbard et al. | 53/500 |
| 3,430,410 | 3/1969 | Heisler | 53/447 X |
| 4,142,345 | 3/1979 | Porter, Jr. | 53/500 X |
| 5,095,684 | 3/1992 | Walker et al. | 53/447 X |

*Primary Examiner*—James F. Coan
*Attorney, Agent, or Firm*—Richard P. Crowley

[57] ABSTRACT

The invention comprises a nested tray-like product separator apparatus and a packaging system employing the nested product separator for the separation of a plurality of generally vertically upright nested plastic tray products into packaging units composed of a defined plurality of the nested tray products. The product separator includes a base plate having a cavity therein and a pair of spaced-apart picker elements, with a tension-biased holdback finger element between the pair of spaced-apart picker elements. The product separator includes a pneumatic cylinder, to move the picker elements sequentially and cyclically between a non-use position and a separating position, wherein the one end of the picker elements extend between selected nested tray products to separate the products. The product separator holdback finger element moves with the picker elements in the non-use position and in the product separating position the finger element is moved to a holdback position which is slightly back from the separating position of the pair of picker elements to provide for the defined spatial separation between the holdback finger elements and the pair of picker elements of the nested tray products. The product separator operates in a packaging system which includes a thermoformer, a trim press and a film bagger packaging machine for the tray products with an electric counter operating from the trim press and connected to an electrical solenoid valve to provide activating of the product separator.

20 Claims, 3 Drawing Sheets

NESTED PLASTIC TRAY SEPARATOR APPARATUS PACKAGING SYSTEM AND METHOD

BACKGROUND OF THE INVENTION

A wide variety of thermoformed, nested, plastic products such as plastic foam or non-foam meat trays, plastic covers, and the like are produced in a nested relationship, which nested plastic products must be separated and packaged in discrete units composed of a defined, selected number of products. Generally, an automated system is employed which comprises a thermoformer to thermoform the plastic product, an adjacent in-line horizontal trim press, a separator to separate the product in units, and a bagger apparatus to receive the counted, nested, generally vertical plastic products, and the bagging, such as by the use of a plastic film wrapper, or otherwise packaging the counted nested products.

In one system, the bagger is adjacent the output end of a horizontal trim press and has a plurality of separate, elongated, U-shaped channels to receive the nested plastic product from the trim press. The nested products are separated periodically and cyclically into desired units for packaging, generally by the vertical reciprocating movement of the channel side wall, having at the end thereof short, inwardly projecting plates which are designed to intervene between the edges of the nested plastic products being fed to the bagger and to separate a selected, counted number of nested plastic products from the nested products being fed into each channel by the trim press. Generally the side walls with separating blades move upwardly, separate the nested products, and then move forward to propel the counted, separated products into the bagger for conveying to a plastic film wrap station for wrapping of the plurality of counted, nested products.

The operation of this type of nested product separator with vertical, closely nested plastic products such as nested shallow plastic foam meat trays, has not been wholly satisfactory, since the separation is often not precise, and nested product edges and products are often damaged by the blade movement while the separator machine itself gets jammed by the tray products. Thus the accuracy, efficiency, and effectiveness of separating a nested plastic product exiting a horizontal trim press into a bagger is not wholly satisfactory with present techniques and equipment.

It is therefore desirable to provide a nested plastic product separator, system and method which accurately, efficiently, and effectively separates nested plastic products and overcomes many of the disadvantages of the prior art.

SUMMARY OF THE INVENTION

The present invention is directed to a nested tray product separating means for separating generally vertical, nested, tray-like products into defined, accurately counted units, typically for packaging purposes.

The product separator comprises a base plate having a cavity therein, generally the base plate forming a part of a packaging apparatus which receives a plurality of vertically upright, nested tray products from an adjacent horizontal trim press. The trim press receives thermo-formed products from a thermoformer apparatus. The packaging apparatus comprises a plurality of channels to receive the vertical nested tray products from the horizontal trim press and is designed to package a plurality of the tray products after counting and separating the nested tray products into defined packaging units such as in a film wrapping packaging process.

The tray product separator includes a pair of spaced-apart picker elements, typically each element curved forwardly in the direction of tray movement and each having a one and the other end, and a tension-biased holdback finger element having a one and the other end and positioned between the pair of picker elements. The tray product separator includes an actuating means, such as a fluid cylinder, which may operate on demand from a solenoid valve means connected to a fluid source and connected to an electric counter, usually connected to the trim press which counter operates the solenoid valve means to effect the actuating of the cylinder in a cyclic timed sequence after a defined number of nested tray products have been produced by the trim press and fed to the bagger packaging machine.

The actuating means is designed to move the pair of picker elements by pivotable movement between a non-use position wherein the pair of picker elements are within the cavity but slightly above or below the plane of the base plate and below the plane of the lower edges of the nested tray products defined path of movement and a nested tray product separating position. In the separating position, the pair of picker elements extend generally vertically upward from the cavity and at the one end are, with the holdback finger element, forced between the edges of the nested trays above the cavity to separate a defined number of nested tray products from the moving line of nested tray products and received in a defined flow path from the horizontal trim press. The tray product separator also provides for the movement of the holdback finger to the non-use position with the pair of picker elements and provides for the finger element, which is tension-biased, to move with the picker elements from the non-use position to a tray holdback position, slightly backwards from the separating position, wherein the holdback finger-like picker element extends between the edges of the stacked tray products which are held in a holdback position temporarily to provide for a further separation of the vertically nested plastic tray products while the pair of picker elements moves slightly forward to the product separating position. The product separator includes a stop means to place the holdback finger elements in a desired holdback position and spaced apart slightly from the picker elements in the separation position. The stop means may provide for an adjustable, for example, threaded stop means, so that the distance between the holdback finger element and the pair of picker elements may be varied by the user as desired.

A nested tray product separator finds particular use in a packaging system wherein the tray product separator may operate responsive from a counter so that after a defined number of nested tray products have been counted, the actuating means may be actuated to provide for an accurate separation of a selected number of the nested tray products. The operation of the picker elements and the finger element permits the one end of these elements to extend between the edges of the nested tray products in an efficient, effective manner, and then to push apart the nested tray products by having the holdback finger holdback slightly forward movement of the tray product, while permitting the pair of picker elements to move forward slightly to provide for a positive space separation between the selected number of nested tray products and the uncounted tray products. Such an arrangement avoids disadvantages and problems associated with past operation wherein a side blade element has merely tried to intervene between the nested tray products by an upward reciprocating movement, and with nothing forcing apart the nested tray products other than the movement of the thin blade element. Such prior art blade movement frequently damages the side edges of the tray product and often jams the feeding device.

The tray product separator may be used with a wide variety of nested-type products, but typically are directed to plastic, such as lightweight nested tray products wherein one part of a product nests or fits in a mating relationship within a portion of an adjacent product, such as meat trays, frozen food trays, covers, plastic containers and the like, where one product is nested securely into another product, and which requires a positive separating action, such as performed by the movement of the picker elements and the hold-back finger as desired, to provide for an efficient separation of the nested tray-type products.

The product separator may be employed with a wide variety of systems, but generally is employed in an overall, automated-type packaging system, wherein a plastic is fed to a thermoformer to make a nested plastic tray product and the thermoformer feeds the formed tray products to a horizontal-type trim press to trim and nest the products, and which trim press pushes the product into one or more channels of a bagger-type packaging machine, which is engaged in the separation and the film wrapping of the selected units for packaging to provide for bagged tray products.

The invention will be described for the purposes of illustration only in connection with certain embodiments, however it is recognized that various modifications, changes, and additions and improvements may be made to the illustrated embodiments by those persons skilled in the art all falling within the spirit and scope of the invention.

DESCRIPTION OF THE EMBODIMENTS

Figure 1:
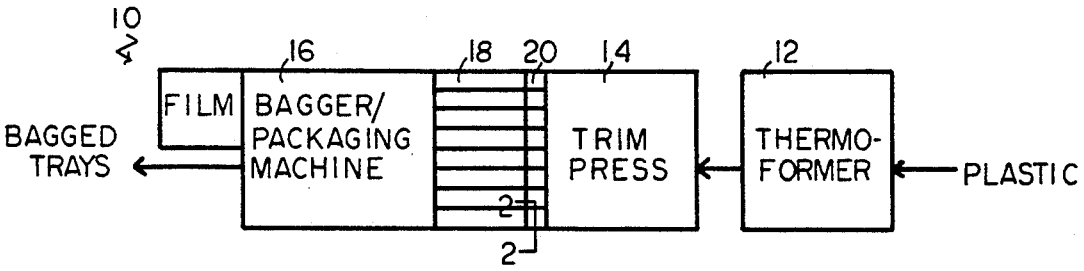
FIG. 1 represents a schematic illustrative diagram showing the manufacturing, trimming, separating and packaging of a nested plastic tray product.

FIG. 1 is a schematic illustration showing a nested tray product packaging system 10 which comprises a thermoformer 12 designed to receive plastic material and to thermoform the material into a plastic tray product, such as for example a foam, polyethylene or polystyrene type tray product. The thermoformer apparatus 12 directs the thermoformed tray products to a horizontal-type trim press 14; for example, such as 100 units per minute of a mechanical horizontal trim press, such as a Sencorp Systems, Inc. of Hyannis, Mass., Model PT30 Trim Press. The trim press typically is located in line and adjacent the thermoformer and receives the formed sheet from the thermoformer 12. The trim press 14 utilizes a stationary vertical die and a moving punch, which punches out the thermoformed sheet received from the thermoformer 12 to provide a nested trimmed tray product. The trim press 14 feeds the nested tray products in a generally vertical arrangement to an automatic bagger packaging machine 16 which includes a plurality of generally extending U-shaped channels 18 to receive the nested tray products directly from the trim press 14, with the product separator 20 at one end of the channel 18 of the bagger 16. The bagger packaging machine is typically an automated system which eliminates manual handling and counting when bagging thermoformed products, and may for example be a Senpacker Packaging Machine from Sencorp Systems, Inc. of Hyannis, Mass. The bagger packaging machine accepts multiple rows of the nested tray products which have been thermoformed and trimmed directly from the output of the horizontal trim press 14, while the product separator separates the nested tray products at a preset count and then the precounted stacks of nested products are then pushed into a bagger packaging machine lane for film wrapping of the defined package units. In operation of the bagger packaging machine, the tray products are indexed in a transverse direction one row at a time to a mechanical bag former so that a bag is formed over the stack of counted nested products, from a roll of film and the bag is sealed in the machine direction with a hot air sealer. While in the transverse direction the sealing/cutoff bar simultaneously seals the front of one pack as well as the rear of the preceding pack and the bagged products are then moved in the transverse direction for the final packaging and shipping.

Figure 2:
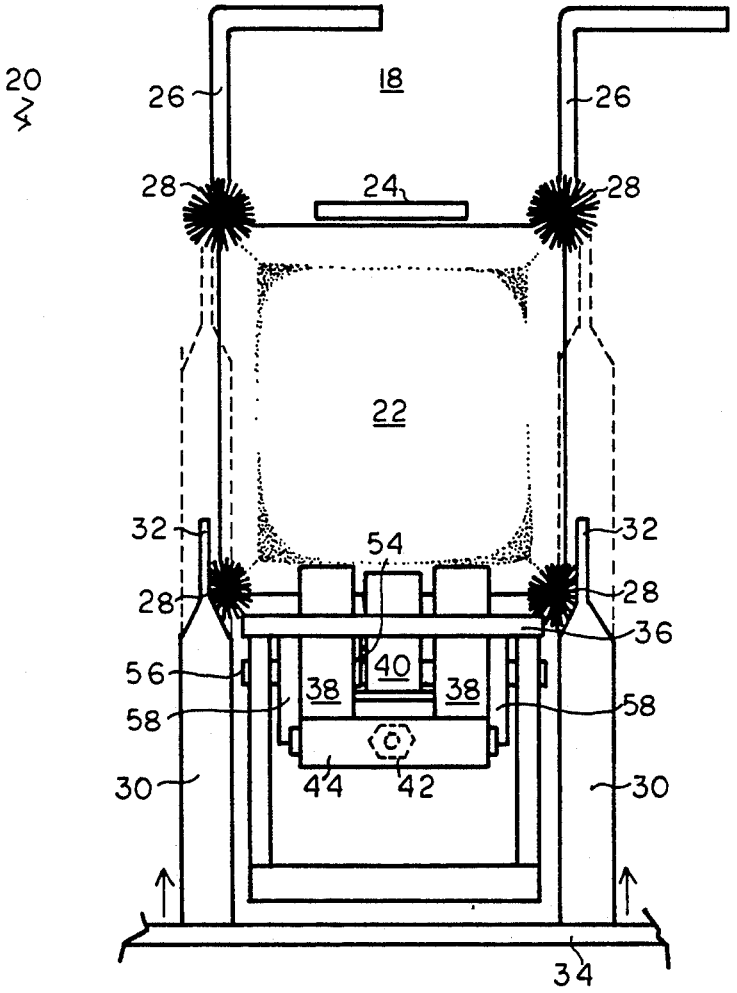
FIG. 2 is an enlarged fragmentary front plan view of a single nested tray product separator along line 2—2 of FIG. 1.

FIG. 2 is a fragmentary, enlarged end plan view of the nested tray product separator 20 as illustrated in the automated system of FIG. 1. As illustrated, a polystyrene foam meat tray 22 is shown in a vertical arrangement with other meat trays stacked behind and in front of it and a guide plate to aid in the guiding of the plurality of meat trays along a defined path to packaging, and a pair of brush holders 26 and product guide brushes 28 in each corner of the meat tray 22 to provide for a defined flow pathway for the nested meat trays 22. The receiving channels 18 from the bagger packaging machine 16 are defined by a pair of side plates 30, and at the end of the side plates are a thin pair of pusher blades 32, which blades are secured to a plate 34, and during a prior art operation would be employed to move upwardly along the side of the vertically nested tray products to separate them and then to move forward to push the selected counted number of separated nested tray products along the path channel 18 and forward into the bagger packaging machine 16. However, in the present invention the pusher blades do not effect the separation, but move upwardly after the initial separation by the product separation apparatus 20 and acts to further separate and push the precounted and separated nested tray products forward.

In operation, as illustrated in FIG. 2, tray product 22 has been separated by the tray product separator of the invention, and the plate 34 with the blades 32 and side edges 30 have not yet moved upwardly so that one side of the blades 32 may engage and push the counted nested tray products 22 forward into the channel 18 and then returned to the position shown in FIG. 2.

The product separator 20 comprises a base plate 36 having a cavity 52 generally centrally located therein and generally rectangular and a pair of picker elements 38 which have been slightly curved at the one end in the direction of motion of stacked trays 22 and a holdback finger element positioned between the picker elements 38 and tension-biased through a spring 54 to a forward position. The pair of picker elements 38 are secured at the one end to a cylinder block 44 which operates at the end of a pneumatic cylinder rod 46 connected to a pneumatic cylinder 42 having air cylinder ports 48 and 50 to receive and discharge pressurized air for the cyclic and sequential operation of the cylinder 42 and its cylinder rod 46 between selected positions. The picker elements 38 and the holdback finger 40 are positioned for pivotable movement with a cotter pin 56 secured to the extending arms 58 which hold the cylinder 42.

Figure 3:
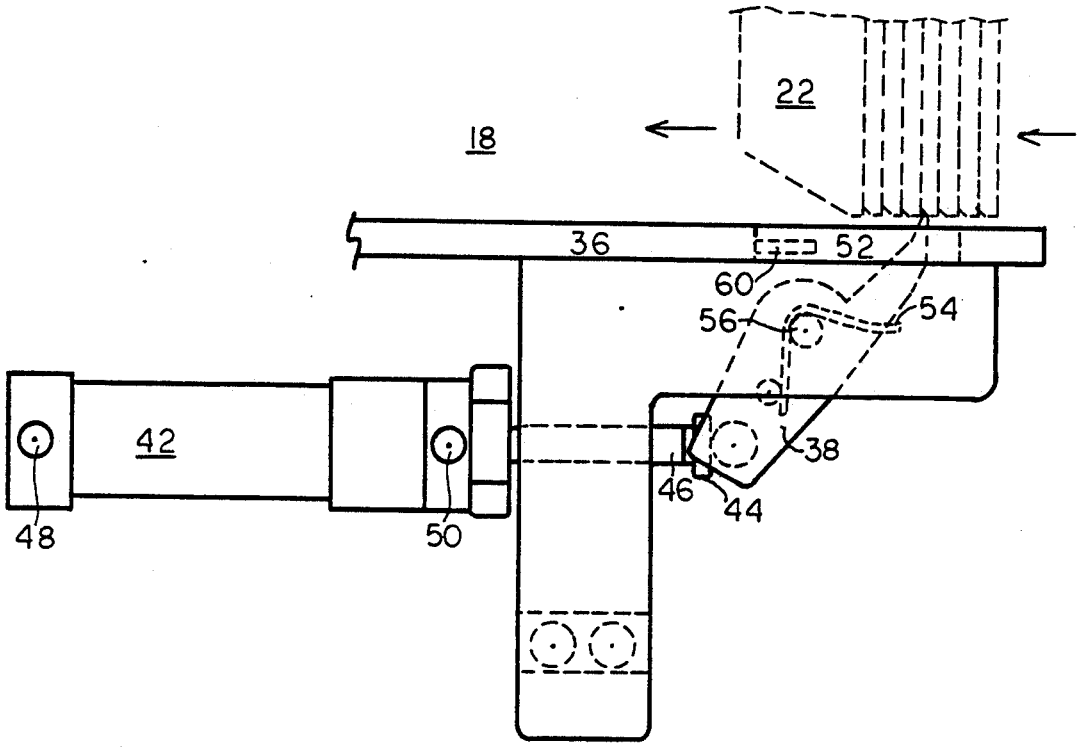
FIG. 3 is a enlarged fragmentary side plan view of the stacked tray product separator of FIG. 2 in a non-use position.

FIG. 3 is a side plan view of the product separator of FIG. 2 in the non-use position and wherein the product separator is shown with the picker fingers 38 and the holdback finger 40 in a non-use position; that is, at the plane of or just slightly above the plane of the cavity and below the plane of the supported vertical nested foam tray products held in a line positioned by the outer support guide brushes 28 and prior to actuation and separation of the nested tray products 22 with the arrows showing the direction of movement of the nested tray products 22 from the horizontal trim press 14 to channel 18 of the bagger packaging 16. As illustrated, the threaded holdback finger stop which horizontally extends outwardly from one side of the base plate 36 and into the cavity 32 to provide for a threadably adjusted stop means for the hold position of the holdback finger 40 so that the distance between the holdback finger 40 and the picker elements 38 may be adjusted as desired by the user.

Figure 4:
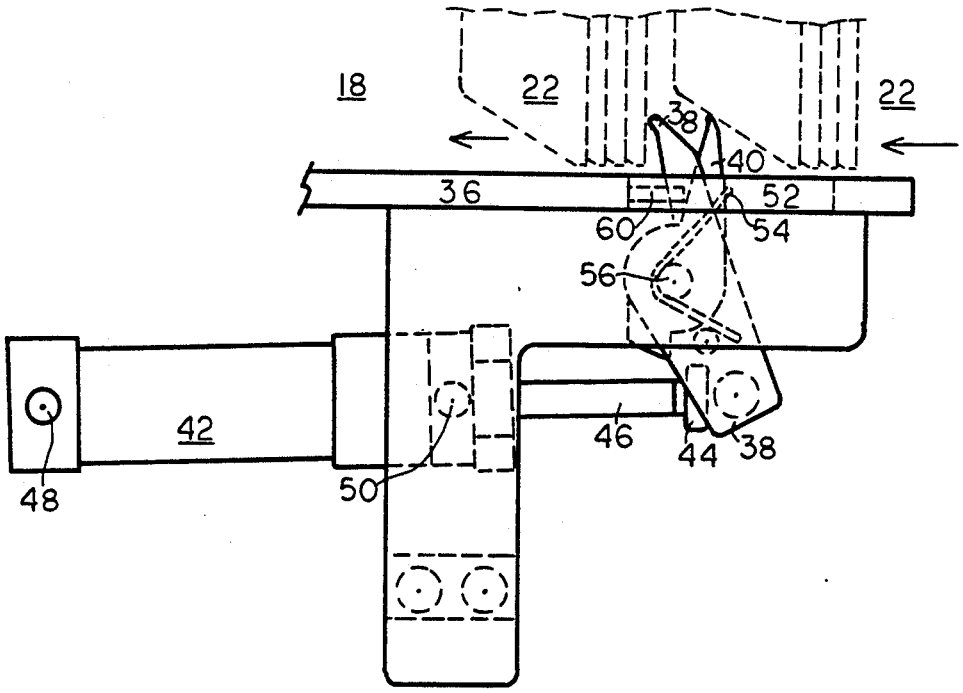
FIG. 4 is an enlarged, fragmentary side plan view of the stack tray product separator of FIG. 2 in a tray product separator position.

FIG. 4 is a partial end view of the product separator 20 of FIG. 2 in the product separating position, wherein the piston rod 46 of the pneumatic piston 42 has been actuated. The process, shown in FIG. 6, that the picker elements 38 have been pivotably moved by movement of the piston rod 46 preferably through cavity 52 and into a forward position of the cavity to extend the top of the picker elements between the sides of the nested trays to force them apart together with the holdback element 40 which also moves with the picker elements 38 to provide for separation. However, as illustrated, the holdback finger 40 does not move forward to the separating position, but rather retains a holdback finger position which distance may vary, but typically may range from, for example, $\frac{3}{8}$–$\frac{5}{8}$", the holdback finger 40 being tension-biased forward to rest against the threaded adjusted stop 60 a defined distance so that the separated tray products 22 may move forward to be packaged. The holdback finger holds the remaining products moving forward from the trim press 14 for a slight period of time to provide a defined separation between the counted and uncounted nested tray products 22. After separation of the nested tray products as shown in FIG. 4, the base 34 with the sides 30 and the blades 32 is then moved upwardly and then forwardly to a position so the blades 32 on either side of the separated tray products 22 may push the counted separated tray products 22 into channel 18 and into the packaging arrangement of the bagger packaging machine 16. The position of the base 34, the blades 32, and the side channels 30 are immediately returned to the position as illustrated in FIG. 2 for further counting and separation of the products by the product separator 20. The position of the blades 32 in the horizontal pusher position is illustrated by dotted lines in FIG. 2.

Figure 5:
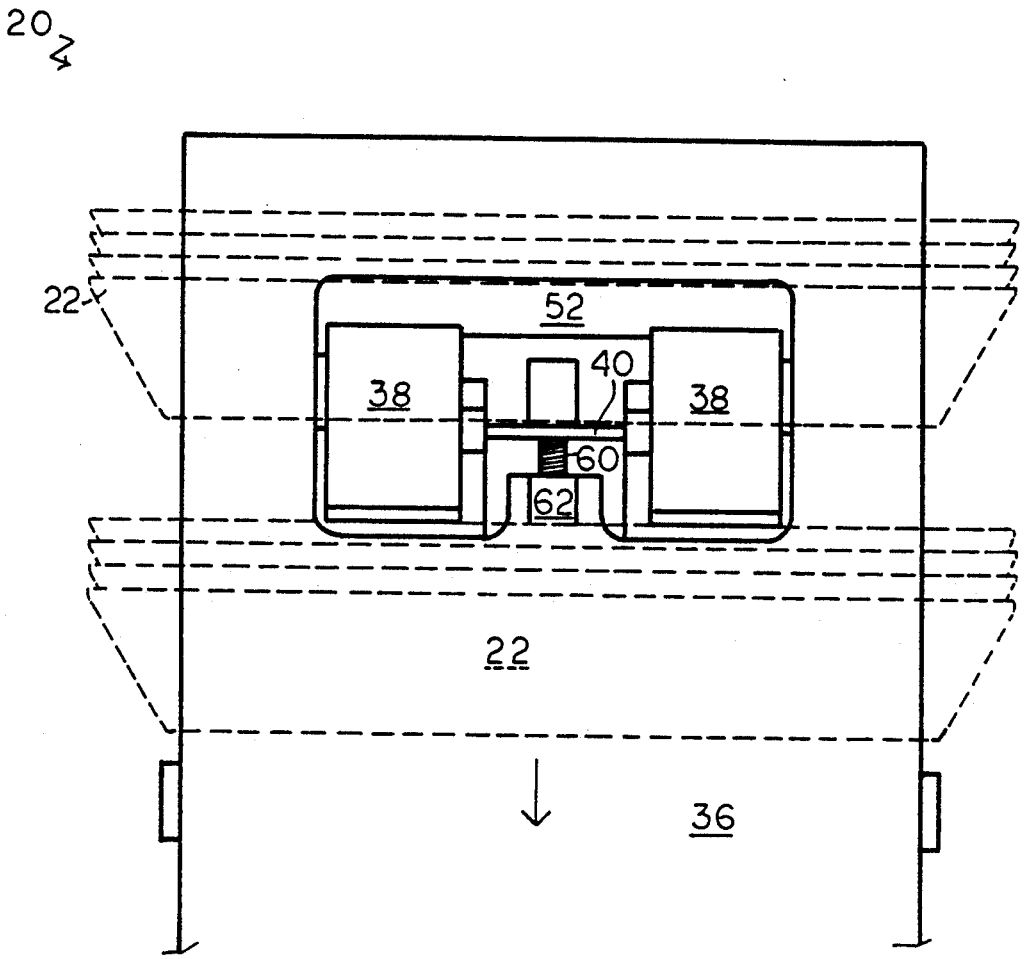
FIG. 5 is a top plan view of the tray product separator of FIG. 4 with vertically stacked tray products shown in dotted lines.

FIG. 5 is a top plan view of the separator 20 as illustrated in FIG. 4 showing the separation of the nested tray products 22 and illustrating a slightly forward extension of the base plates 62 into the cavity 52, which extension of the base plate may serve as a stop means in place of the adjustable threaded stop means as illustrated in FIGS. 2 and 3 of the holdback finger 40.

Figure 6:
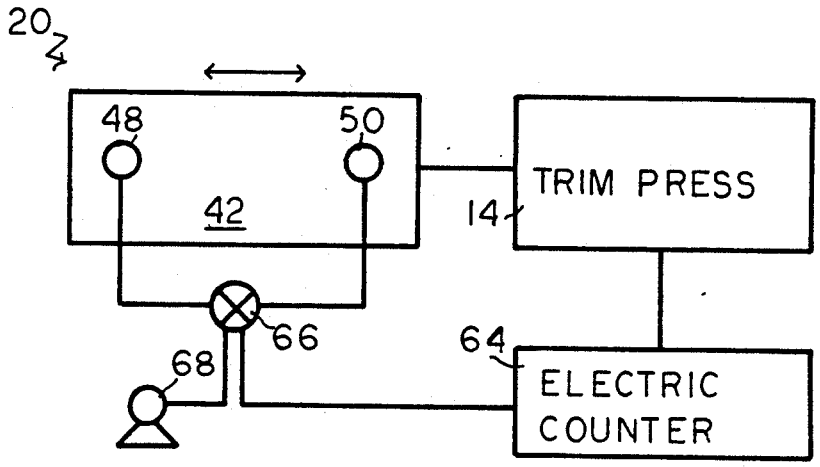
FIG. 6 is a schematic diagram of the system of FIG. 1 with the product separator.

FIG. 6 is a schematic illustration of the operation system of the product separator 20 wherein the pneumatic cylinder 42, having air ports 48 and 50, are connected to an electrically operated solenoid valve, which electrically operated valve 66 is connected to an electrically operated counter 64, which counter is connected to the trim press to count the nested trimmed tray products from the trim press 14 while the cylinder 42 and the ports 48 and 50 are connected to a source of air pressure 68 such as a pneumatic air compressor. In the system, the electric counters 64 precounts the nested trim tray products from the trim press 14 and are delivered to the channels 18 of the bagger packaging machinery 16 and after a predetermined number actuates the solenoid operated valve 66 delivers pressed air through the air port 48 or 50 to actuate the cylinder rod 46 and to cyclically and sequentially place the picker elements between a non-use and separating position and a holdback finger between a non-use and a holdback position.

The nested tray product separator as described and illustrated and in the automatic packaging system as described and illustrated provides for a uniform, accurate, efficient separation of nested products and reduces damage to the products and jamming of the bagger packaging machine and automatic operation and permits high speed operation of the trim press and bagger machine and avoids many of the disadvantages associated with the prior art techniques of employing high blade separation of nested tray products.

What is claimed is:

1. A packaging apparatus which comprises:

a) a channel receiving means having a one and other end, with one end to receive a plurality of vertically nested plastic tray products to be packaged into separate packages;

b) a tray product separating means at the one end of the receiving means to separate the received tray products into a plurality of separate units composed of a defined plurality of vertical nested plastic tray products;

c) feeding means at the one end of the receiving means to feed each unit of separated nested tray products to a packaging means; and d) a packaging means at the other end of the receiving means to package each separated unit composed of the nested tray products, the improvement which comprises:

i) a base plate having a cavity therein, the base plate forming a part of the floor base of the receiving means;

ii) a pair of spaced-apart picker elements each having a one and other end;

iii) a tension-biased holdback finger element having an one and other end and positioned between the picker elements;

iv) separator activating means to move the picker elements sequentially and cyclically between a non-use position within the cavity and a tray product separating position extending generally vertically upward from the cavity and to have one end of the picker element extend between selected nested tray products to separate a defined number of nested tray products from the nested tray products directed to the receiving means;

v) the separator activating means moving the holdback finger element simultaneously with the picker elements to the non-use position and the finger element tension-biased to a generally vertical product tray holdback position within the cavity, wherein the holdback finger element is spaced-apart a defined distance from the picker elements in the product separator position to hold back temporarily the plurality of vertically nested plastic tray products being directed into the receiving means; and vi) stop means to hold the holdback finger element in the holdback position while the pair of picker elements move to the product separating position; and vii) product counter means to activate the separator activating means to provide for the separation of a defined number of a plurality of stacked tray products to compose a defined unit for packaging.

2. The apparatus of claim 1 wherein the receiving means comprises a U-shaped channel having a channel opening, and having a pair of spaced-apart side walls and a floor to receive and hold vertically stacked plastic tray products within the channel opening.

3. The apparatus of claim 2 wherein the feeding means comprises means to move a portion of the receiving means between a fixed, vertical and a horizontal position and a pair of blade-like projections on the channel side wall to feed the separated unit of the stacked tray products along a defined flow path to the packaging means.

4. The apparatus of claim 1 wherein the pair of picker elements each have one end slightly curved in the direction of the movement of the nested tray products in the receiving means.

5. The apparatus of claim 1 which includes a pivot means intermediate the one and other ends of the picker elements and the holdback finger to provide for pivotable movement of the picker elements and the holdback finger element between their respective positions.

6. The apparatus of claim 1 wherein the stop means comprises a generally horizontally extended element within the cavity to stop the finger element in a defined stop position to aid in separating the tray products forward and backward from the picker elements and the holdback finger.

7. The apparatus of claim 1 wherein the stop means comprises a threaded extender which may be adjusted in distance between the picker elements in the product tray separator position and the holdback finger element in the holdback position.

8. The apparatus of claim 1 wherein the separator activating means comprises a fluid cylinder means having a piston rod secured to the other end of the picker elements for movement of the picker elements.

9. The apparatus of claim 8 which includes:

a) a pressurized fluid source connected to the fluid cylinder means;

b) a solenoid valve activated means between the fluid cylinder and the fluid source; and c) a product counter means in communication with the activated valve means to provide for the sequential and cyclic operation of the fluid cylinder.

10. A system which comprises:

a) the packaging apparatus of claim 1;

b) a thermoformer apparatus for the thermoforming of plastic tray products;

c) a horizontal trim press apparatus for the trimming of the thermoformed tray products and directing the trimmed, nested, vertically upright tray products to the receiving means of the packaging apparatus.

11. A nested tray product separator apparatus for the separation of a plurality of generally vertically arranged nested tray products moving along a flow path into a defined number of tray products which separator apparatus comprises:

a) base plate having a cavity therein, the base plate positioned slightly below the flow path of the lower edge of a plurality of nested tray products;

b) a pair of spaced apart picker elements, each having a one and other end;

c) a tension-biased holdback finger element positioned between the pair of picker elements and having a one end and other end;

d) pivot means to provide for the pivotable movement of the picker elements and the holdback finger element;

e) the picker elements adapted to move in the cavity between a non-use position below the plane of the lower edge of the plurality of vertical nested tray products in the flow path, and a separating position wherein the one end of the picker elements extend upwardly from the cavity and between the lower edge of a pair of nested tray products in the flow path to separate spatially a selected number of nested tray products in the flow path; and f) the holdback finger element adapted to move with the picker elements between the non-use position and a tray product holdback position extending upwardly from the cavity and slightly spaced apart from the separating position of the picker elements to form a defined spatial separation between the separated counted nested tray products and the uncounted nested tray products moving along the flow path; and g) means to activate pivotably the picker elements and the holdback finger elements in a cyclic timed sequence between the non-use position and the separating holdback position.

12. The apparatus of claim 11 wherein the picker elements at the one end are generally arcuately curved froward in the flow path to facilitate the separation of the nested tray products.

13. The apparatus of claim 11 wherein the activating means comprises a fluid cylinder with a piston rod, the rod secured to the other end of the picker elements for pivotable movement of the picker element.

14. The apparatus of claim 11 which includes a tray product counter means connected to the activating means.

15. A system which comprises:

a) a thermoformer means to produce a plastic tray product;

b) a horizontal trim press means to trim and provide a plurality of plastic nested tray products;

c) the separator apparatus of claim 11 to receive the nested tray products, and to separate the nested tray products into a counted number of nested tray products; and d) a packaging means to receive the counted nested tray products and to package the counted nested tray products in a packaging unit.

16. The system of claim 15 wherein the thermoformer means includes a nested tray product counter means in communication with the activating means of the separator apparatus.

17. The system of claim 15 wherein the packaging means comprises a plastic film packaging means having a plurality of open U-shaped channels to receive counted nested tray products.

18. The system of claim 17 wherein the packaging means includes means to propel the counted nested tray products to a packaging position.

19. A method of providing a plurality of counted plastic nested tray products from a defined moving flow path of a plurality of vertically oriented plastic nested tray products which method comprises:

a) counting a defined number of the nested tray products along the flow path;

b) inserting a pair of picker elements and an intermediate tension-biased holdback finger element between the last nested tray product of the counted products and the first nested tray products of the flow path to place the picker element in a separating position to separate the last and first nested tray products;

c) placing the holdback finger element in a slightly spaced apart holdback position from the picker elements to hold back temporarily the first nested tray product to provide a defined spatial separation between the first and last nested tray products in the flow path and to permit the efficient separation and forward movement of the counted nested tray products; and d) placing the picker element and holdback finger element in a non-use position below the flow path to permit the continued counting of the nested tray products.

20. The method of claim 19 which pivotably moves the picker elements and holdback finger element by a pneumatic means.

* * * * *